US007333122B2

(12) United States Patent
Park et al.

(10) Patent No.: US 7,333,122 B2
(45) Date of Patent: Feb. 19, 2008

(54) METHOD OF PRINTING THERMAL MEDIA BY ALIGNING IMAGE

(75) Inventors: Min-Su Park, Suwon-si (KR); Young-do Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 209 days.

(21) Appl. No.: 11/176,187

(22) Filed: Jul. 8, 2005

(65) Prior Publication Data

US 2006/0007293 A1 Jan. 12, 2006

(30) Foreign Application Priority Data

Jul. 10, 2004 (KR) ..... 10-2004-0053775

(51) Int. Cl.
*B41J 2/315* (2006.01)

(52) U.S. Cl. ..... 347/171

(58) Field of Classification Search ..... 347/171, 347/173, 174

See application file for complete search history.

(56) References Cited

U.S. PATENT DOCUMENTS

| | | | |
|---|---|---|---|
| 6,018,640 | A | 1/2000 | Blackman et al. |
| 6,373,042 | B1 | 4/2002 | Kretschmann et al. |
| 6,411,317 | B1 * | 6/2002 | Fukuda ..... 347/173 |
| 6,511,239 | B1 | 1/2003 | Kretschmann et al. |
| 6,539,199 | B1 | 3/2003 | Miyata et al. |
| 6,567,644 | B1 | 5/2003 | Yasui |
| 6,644,652 | B1 | 11/2003 | Walsh et al. |
| 6,667,756 | B2 | 12/2003 | Conrow et al. |
| 2003/0125206 | A1 | 7/2003 | Bhatt et al. |

FOREIGN PATENT DOCUMENTS

| | | |
|---|---|---|
| JP | 2001-310503 | 11/2001 |
| JP | 2001-331073 | 11/2001 |
| KR | 2003-0092853 | 12/2003 |
| KR | 2004-0021160 | 3/2004 |
| KR | 2004-0024415 | 3/2004 |

* cited by examiner

*Primary Examiner*—K. Feggins
(74) *Attorney, Agent, or Firm*—Roylance, Abrams, Berdo & Goodman, L.L.P.

(57) ABSTRACT

Provided is a method of printing thermal media by aligning an image using a printer in which a thermal printhead, a feeding roller, and an edge detection sensor are sequentially disposed in a print proceeding direction. The method includes the steps of feeding a thermal medium having a first surface and a second surface so that a front edge of the thermal medium is movable a first distance from the edge detection sensor. The thermal medium print starting position is located under a heating element of the thermal printhead. A printing process for the first surface is performed while feeding the medium nad the thermal printhead is rotated so that the thermal printhead faces the second surface of the thermal medium. The thermal medium is fed so that the front edge of the thermal medium moves a second distance from the edge detection sensor. The print starting position of the second surface is located under the heating element of the thermal printhead. A printing process is performed for the second surface while feeding the thermal medium.

12 Claims, 6 Drawing Sheets

METHOD OF PRINTING THERMAL MEDIA BY ALIGNING IMAGE

CROSS-REFERENCE TO RELATED APPLICATIONS

This application claims the benefit of Korean Patent Application No. 10-2004-0053775, filed on Jul. 10, 2004, the entire disclosure of which is hereby incorporated by reference.

BACKGROUND OF THE INVENTION

1. Field of the Invention

The present invention relates to a method of printing a thermal medium by aligning an image. More particularly, the present invention relates to a method of printing a thermal medium that is used in a thermal printer by aligning print starting positions of first and second surfaces of the thermal medium.

2. Description of the Related Art

A thermal printer can be classified into a printer using a medium that represents a predetermined color according to heat applied to a thermal medium or a printer using an ink ribbon that transfers a predetermined color onto a general medium according to heat applied to the ink ribbon. The latter one uses a driving device for operating the ink ribbon. Thus it has a fairly complex structure and a relatively high price. Also, since the ink ribbon should be replaced continually, a printing price per page may be high.

Referring to FIG. 1, a thermal medium 10 includes a base sheet 11 having first and second surfaces 10*a* and 10*b* on which ink layers of predetermined colors are formed, respectively. The ink layers are formed to have different colors from each other. For example, a yellow (Y) layer and a magenta (M) layer are sequentially stacked on the first surface 10*a*, and a cyan (C) layer is formed on the second surface 10*b*. It is desirable that the base sheet 11 is formed of a transparent material. Reflective layer 13 reflects light so that a color image can be seen on the first surface 10*a*. U.S. Published Patent Application No. 2003/0125206 discloses an example of the thermal medium 10.

The thermal printer uses a thermal printhead (TPH). The thermal printhead has heating elements which are disposed perpendicularly to a proceeding direction of the printing sheet.

FIG. 2 illustrates a structure of a general thermal printer.

Referring to FIG. 2, the thermal printer includes a feeding roller 2 that conveys the thermal medium 10, a platen 3 to support a surface of the medium 10, and a TPH 4 to form an image on the medium 10 that is disposed on the platen 3.

When the TPH is rotated for printing images on the second surface after printing images on the first surface, if the TPH is not aligned with the medium, the color printing operation may be improperly performed.

Therefore, a method of aligning a print starting position of the medium is required when the first and second surfaces of the medium are printed.

Accordingly, there is a need for an improved method of aligning a print starting position of the medium when the first and second surfaces of the medium are printed.

SUMMARY OF THE INVENTION

An aspect of the present invention is to solve at least the above problems and/or disadvantages and to provide at least the advantages described below. Accordingly, an aspect of the present invention is to provide a method for aligning a thermal medium print starting position for use in a thermal printer.

According to an aspect of the present invention, there is provided a method of printing thermal media by aligning an image using a printer, in which a thermal printhead, a feeding roller, and an edge detection sensor are sequentially disposed in a print proceeding direction. The method includes the steps of feeding a thermal medium having a first surface and a second surface so that a front edge of the thermal medium moves a first distance from the edge detection sensor. The thermal medium print starting position is located under a heating element of the thermal printhead. A printing process is performed for the first surface while feeding the medium. The thermal printhead is rotated so that the thermal printhead faces the second surface of the thermal medium. The thermal medium is fed so that the front edge of the thermal medium moves a second distance from the edge detection sensor. The print starting position of the second surface is located under the heating element of the thermal printhead. A printing process is performed for the second surface while feeding the thermal medium.

The edge detection sensor may be an optical sensor.

Feeding of the first surface of the thermal medium may include detecting the front edge of the thermal medium using the edge detection sensor and controlling rotation of the feeding roller so that the front edge of the thermal medium moves about the same amount as the first distance from the sensor.

Feeding of the second surface of the thermal medium may include detecting the front edge of the thermal medium using the edge detection sensor and controlling rotation of the feeding roller so that the front edge of the thermal medium moves about the same amount as the second distance from the sensor.

The thermal medium may include a printing region and a tear-off region having the front edge. The print starting position is preferably formed on the tear-off region.

According to another aspect of the present invention, there is provided a method of printing thermal media by aligning an image using a printer, in which a thermal printhead, a feeding roller, and an edge detection sensor are sequentially disposed in a print proceeding direction. The method includes the steps of feeding a thermal medium having first and second surfaces so that a front edge of the thermal medium moves a first distance from the edge detection sensor. The thermal medium print starting position is located at a position further away from a lower portion of a heating element of the thermal printhead. A printing process is started for the first surface of the thermal medium when the print starting position is located under the heating element, while feeding the thermal medium. The thermal printhead rotates so that the thermal printhead faces the second surface of the thermal medium. The thermal medium is fed so that the front edge of the thermal medium is moved a second distance from the edge detection sensor and the print starting position of the second surface is located at a position further away from the heating element of the thermal printhead. A printing process is started for the second surface when the print starting position is located under the heating element, while feeding the thermal medium.

The first distance may be a distance equal to the summation of a distance between the front edge and the print starting position, and a predetermined third distance. The printing of the first surface may be performed by starting the printing process when the thermal medium is fed as much as the third distance.

The second distance may be equal to the summation of a distance between the front edge and the print starting position, and a predetermined fourth distance. The printing of the second surface may be performed by starting the printing process when the thermal medium is fed as much as the fourth distance.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
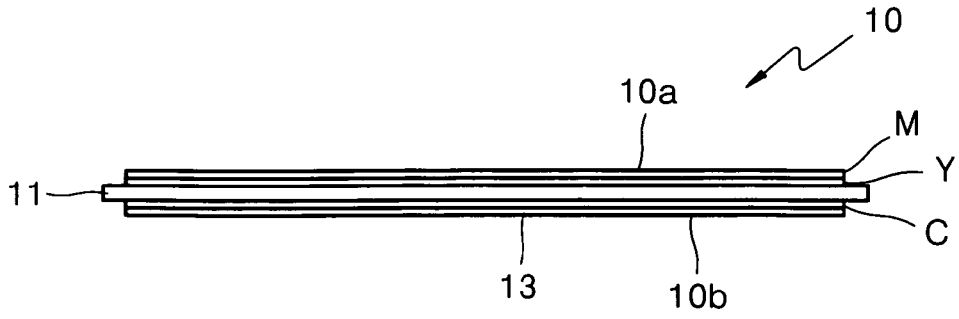
FIG. 1 (PRIOR ART)
FIG. 1 is a cross-sectional view showing a general thermal medium.
Figure 2:
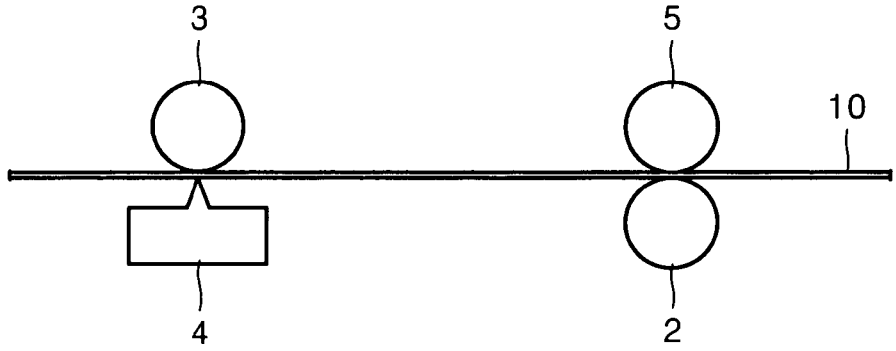
FIG. 2 (PRIOR ART)
FIG. 2 is a view illustrating a structure of a general thermal printer.
Figure 3:
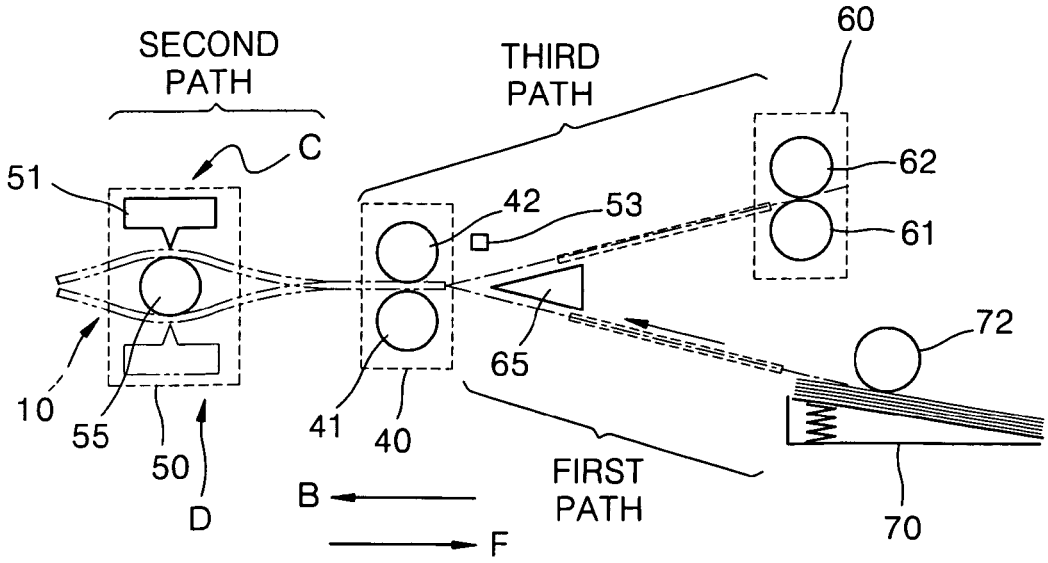
FIG. 3 is a view showing a thermal printer using a printing method of aligning an image of a thermal medium in accordance with an embodiment of the present invention.

FIG. 3 is a view showing a thermal printer using a printing method of aligning an image on a thermal medium in accordance with an embodiment of the present invention.

As shown in FIG. 3, the thermal printer includes at least a first path, a second path, and a third path. The thermal printer conveys a thermal medium along the above paths. A pickup roller 72 picks up the medium 10 from a media storage unit 70 and conveys the medium along the first path. The first path is a supplying path of the medium 10 to move the medium 10 toward the second path. The second path is an area where the medium 10 is back-fed to a direction represented by arrow B and forward fed to a direction represented by arrow F (printing direction) for a printing operation. The third path is a path along which the medium 10 is finally discharged after printing. That is, after the first surface of the medium 10 is printed, the medium 10 is returned to the second path and the second surface thereof is printed. The medium 10 is then conveyed to the third path.

A media guide 65 is disposed between the first path and the third path. The media guide 65 guides the medium 10 from the first path to the second path. Additionally, the media guide 65 guides the medium 10 from the second path to the third path. Furthermore, the media guide 65 guides the medium 10 from the second path to proceed toward the third path only. Thus, the medium 10 is prevented from proceeding from the second path toward the first path.

In the second path, an image is formed by an image forming unit 50. Before the images are formed on the first and second surfaces of the medium 10, locations of a thermal printhead (TPH) 51 and a platen roller 55 of the image forming unit 50 should be arranged at predetermined positions. That is, if the image is formed on the first surface of the medium 10, the TPH 51 should be located at the portion C, as seen in FIG. 3. If the image is formed on the second surface of the medium 10, the TPH 51 should be located at portion D. It is desirable that the location of the TPH 51 is changed by rotating the platen roller 55. The TPH 51 is preferably centered on a rotary shaft of the platen roller 55. The location change of the TPH 51 is performed when the TPH 51 is not obstructed by the medium 10. For example, before the medium 10 is supplied from the first path, or when the medium 10 is not returned to the second path after being conveyed toward the third path during the image formation on the first surface.

When the medium 10, the first surface of which is printed, is backfed to the second path, the image is formed on the second surface of the medium 10 by the rotated TPH 51. In the above process, the medium 10 gradually proceeds via a convey unit 40, and further proceeds through the second path for discharging through a media discharging unit 60 after the image is formed on the second surface. The convey unit 40 includes a feeding roller 41 to convey the medium 10 and an idle roller 42 to push the medium 10 entering between the feeding roller 41 and the idle roller 42 toward the feeding roller 41.

Optical sensor 53 detects an edge of the medium 10, and functions thereof will be described later for purposes of clarity and conciseness. The media discharging unit 60 includes a discharge roller 61 and an idle roller 62. The discharge roller 61 and the pickup roller 72 may be formed integrally using one roller having a combined function; however, other suitable arrangements and constructions may be used.

Figure 4:
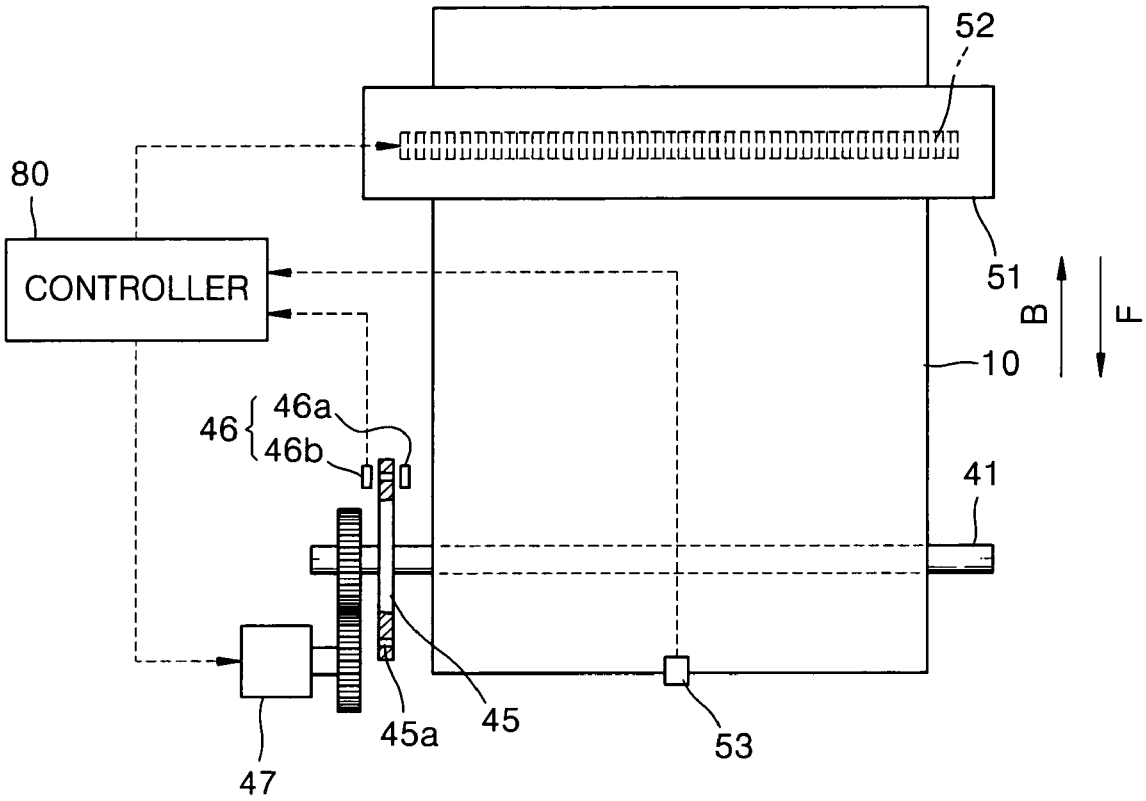
FIG. 4 is a plan view showing a part of a device using the printing method of aligning an image of the thermal medium in accordance with an embodiment of the present invention.
Figure 5:
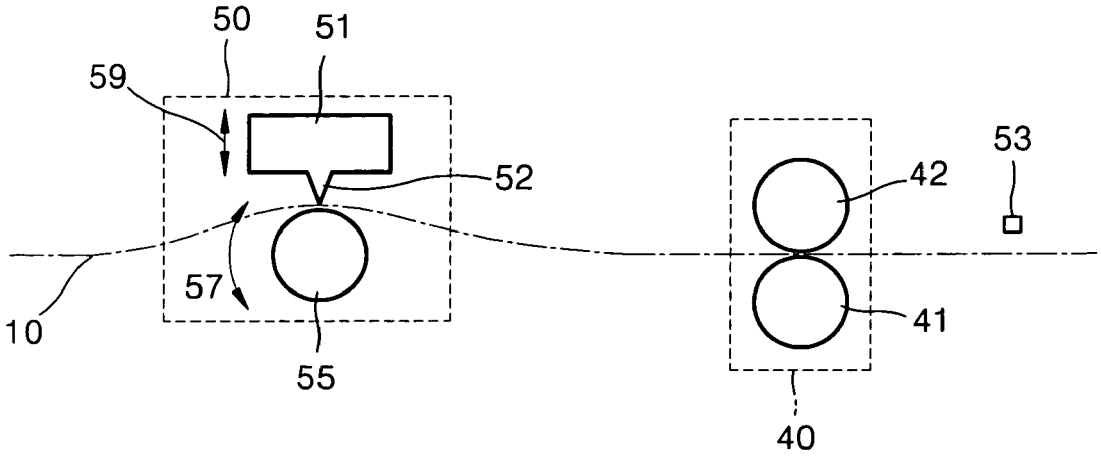
FIG. 5 is a partial side view showing the device of FIG. 4.

FIG. 4 is a schematic plan view showing a part of a device using the method of printing the thermal media by aligning images in accordance with an embodiment of the present invention. FIG. 5 is a schematic side view showing the device of FIG. 4.

Referring to FIGS. 4 and 5, the TPH 51, the feeding roller 41, and the optical sensor 53 are sequentially disposed in the conveying direction of the thermal medium 10. The thermal medium 10 enters between the platen roller 55 and the TPH 51, and is controlled by the operation of the feeding roller 41.

In the TPH 51, a plurality of heating elements 52 are disposed perpendicularly to the medium proceeding direction in a row or a plurality of rows. The heating elements 52, controlled by a voltage applying signal, emit heat for a predetermined time and up to a predetermined temperature according to the colors being utilized.

The medium 10 is conveyed in the direction represented by arrow B, that is, the backfeeding direction, or to the direction represented by arrow F, that is, the printing direction by the feeding roller 41. An encoder disk wheel 45 is installed on an outer circumference of the feeding roller 41. Slits 45*a* are formed on an edge of the encoder disc wheel 45 at predetermined intervals. Rotary encoder sensors 46, including a light emitting portion 46*a* and a light receiving portion 46*b*, are mounted on both sides of the slits 45*a*. The light emitting unit 46*a* of the rotary encoder sensor 46 emits light at a predetermined speed and the light receiving unit 46*b* generates pulse signals whenever it meets the slit 45*a*. A controller 80 counts the pulse signals to measure the conveyed distance of the medium 10 that is conveyed by the feeding roller 41. The controller 80 drives a driving motor 47 to control the conveyed distance of the medium 10 that is conveyed to the feeding roller 41.

The thermal printer includes a rotating unit 57 that rotates the TPH 51 and the platen roller 55 for performing the printing process for the second surface after performing the printing process for the first surface of the medium 10. A vertical moving unit 59 separates the TPH 51 from the printing path or pushes the TPH 51 close to the printing path. The vertical moving unit 59 separates the TPH 51 a predetermined distance. For example, about 1~2 mm, from the platen roller 55 so that the medium 10 may pass through the TPH 51 and the platen roller 55 when the medium 10 is backfed.

The optical sensor 53 is disposed in front of the feeding roller 41 in the forward feeding direction. The optical sensor 53 transmits an optical output value of the medium 10 that is conveyed under the optical sensor 53 to the controller 80. The controller 80 detects an edge of the medium 10 from the optical output value.

Figure 6:
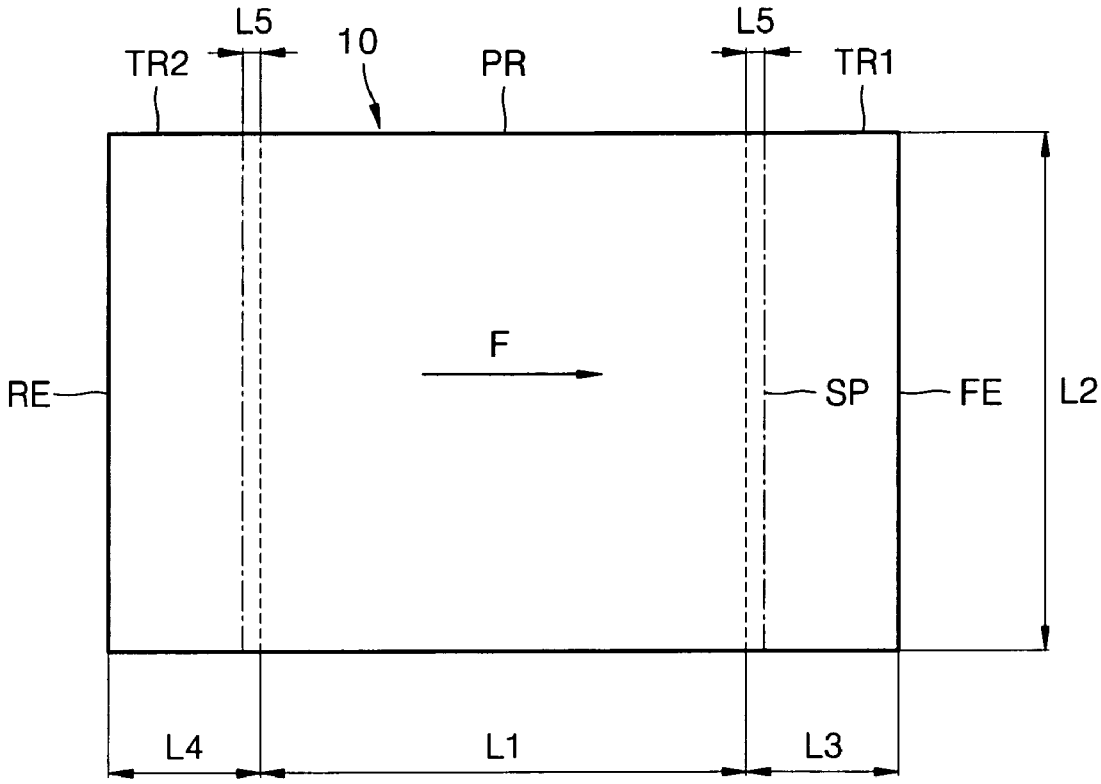
FIG. 6 is a view showing the thermal medium used in an embodiment of the present invention.

FIG. 6 is a view showing an example of the thermal medium used in the embodiment of the present invention.

Referring to FIG. 6, the thermal medium 10 may be divided into a printing region (PR), and tear-off regions TR1 and TR2. The PR has a transverse length (L1) of about 6 inches and a vertical length (L2) of about 4 inches. The TR1 has a transverse length (L3) of about 1 inch and TR2 has a transverse length (L4) of about ⅓ inch. Arrow F denotes the direction of conveying the medium 10 for forward feeding the medium in the printing process. Reference numeral FE denotes a front edge of the medium 10, and reference numeral RE denotes a rear edge of the medium 10. In FIG. 6, a dotted line is a tear-off line, and dashed dotted lines represent starting and end positions of an actual printing region for a borderless printing operation. A distance (L5) between the dotted line and the dashed dotted line is about 2 mm. In addition, reference numeral SP denotes a print starting position.

The printing method of aligning an image on the thermal media in accordance with an embodiment of the present invention will be described with reference to the drawings.

Figure 7:
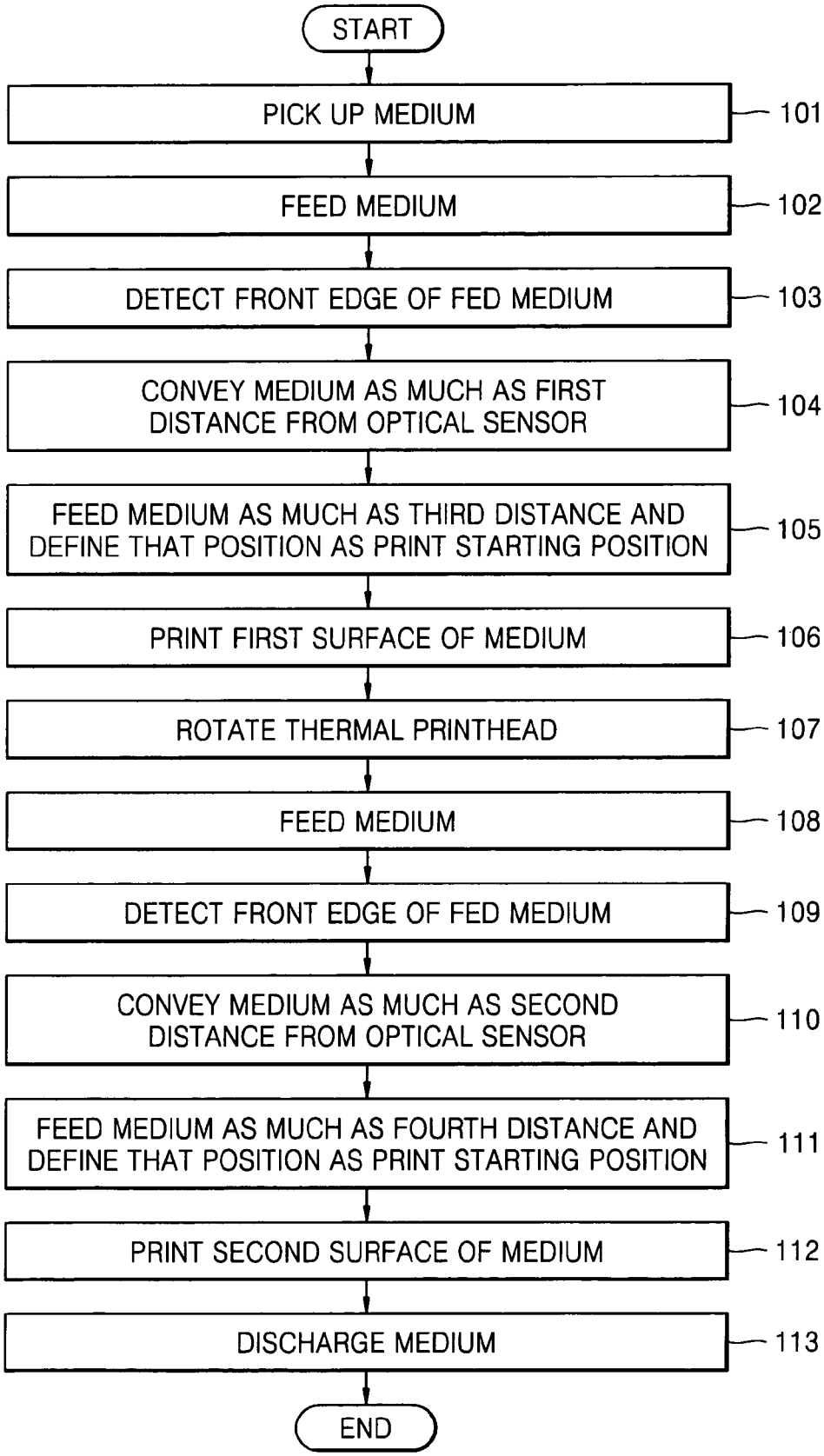
FIG. 7 is a flow chart illustrating the printing method of aligning an image on the thermal medium in accordance with an embodiment of the present invention.

FIG. 7 is a flow chart illustrating the method of aligning the image on the thermal media in accordance with an embodiment of the present invention.

When a printing command is input into the controller 80 from a computer that is connected with the printer, a sheet of thermal media 10 is picked up by the pickup roller 72 from the media container 70 and enters the first path (operation 101 of FIG. 7).

The medium 10 enters the first path and is supplied to the feeding roller 41 guided by the media guide 65. The feeding roller 41 backfeeds the medium 10 to the second path in the direction represented by the arrow B (operation 102 of FIG. 7). Here, the TPH 10 ascends so that the medium 10 can pass between the TPH 51 and the platen roller 55 relatively easily.

Figure 8A:
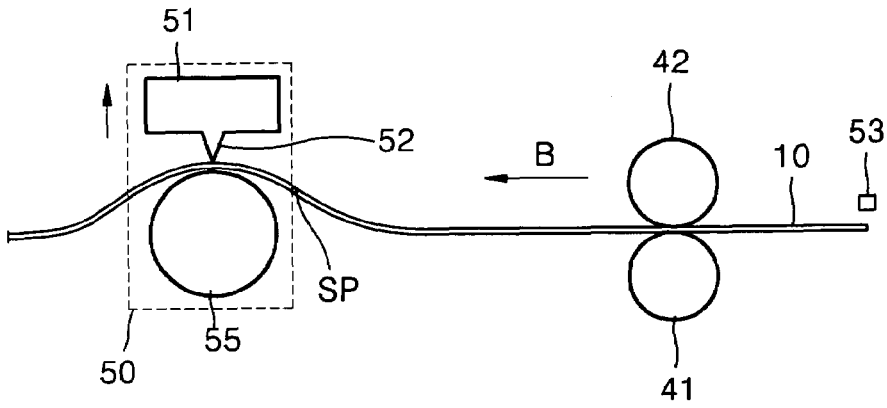
FIGS. 8A through 8F are views illustrating the printing method of aligning an image on the thermal medium in accordance with an embodiment of the present invention.
Figure 8B:
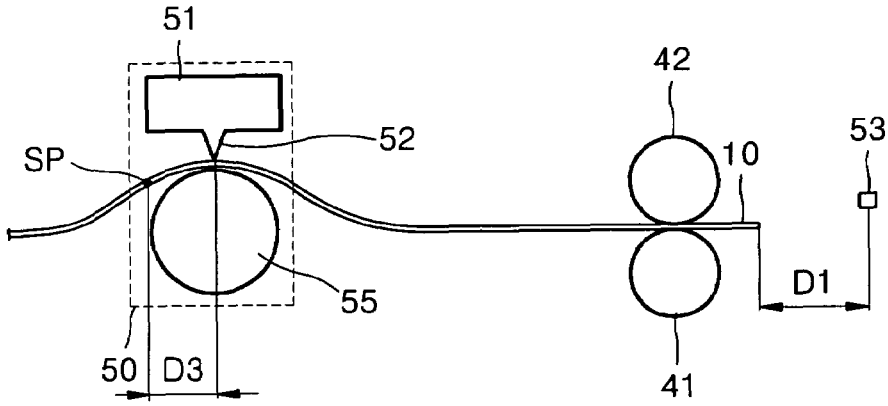

As shown in FIG. 8A, when the front edge of the medium 10 is detected by the optical sensor 53 in the backfeeding process (operation 103 of FIG. 7), the medium 10 is further backfed as much as a first distance D1 from the optical sensor 53 (operation 104). In addition, as shown in FIG. 8B, the print starting position SP of the medium is a point that is further moved as much as a third distance D3 from the heating element 52 of the TPH 51. The first distance D1 is the proceeding distance of the medium 10 from the point when the front edge of the medium 10 is detected by the optical sensor 53, measured by the rotary encoder sensor 46.

Figure 8C:
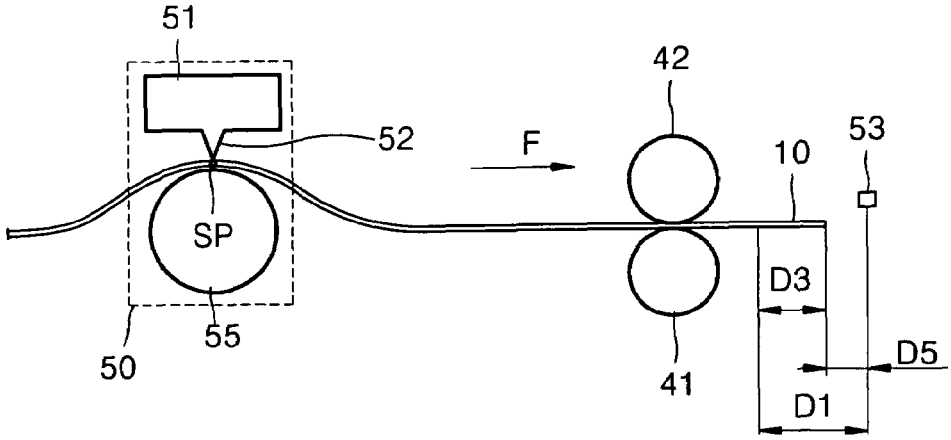

When the printing process for the first surface starts, the medium 10 is fed forwardly in the direction represented by the arrow F about the same as the third distance D3. Thus, the print starting position (SP) may be disposed under the heating element 52 of the TPH 51 as shown in FIG. 8C (operation 105 of FIG. 7).

In addition, the color image data corresponding to the printing layer formed on the first surface, for example, yellow (Y) and magenta (M) image data are transmitted to the TPH 51 from the controller 80 to perform the printing process (operation 106 of FIG. 7).

Figure 8D:
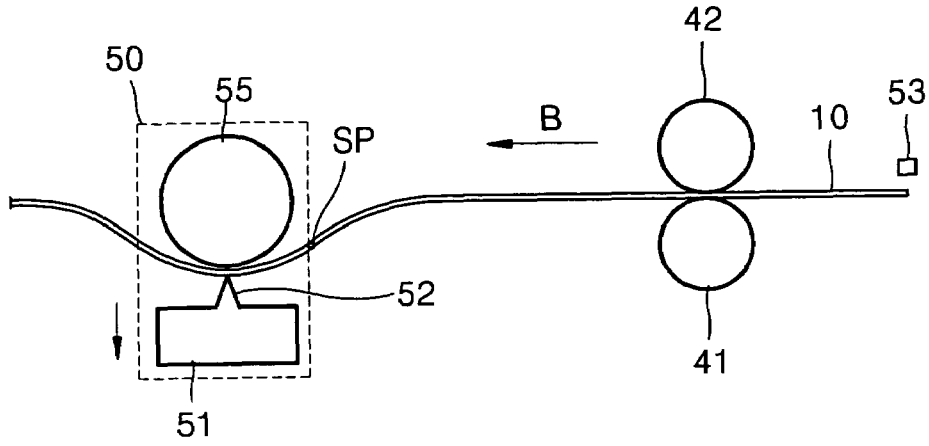
Figure 8E:
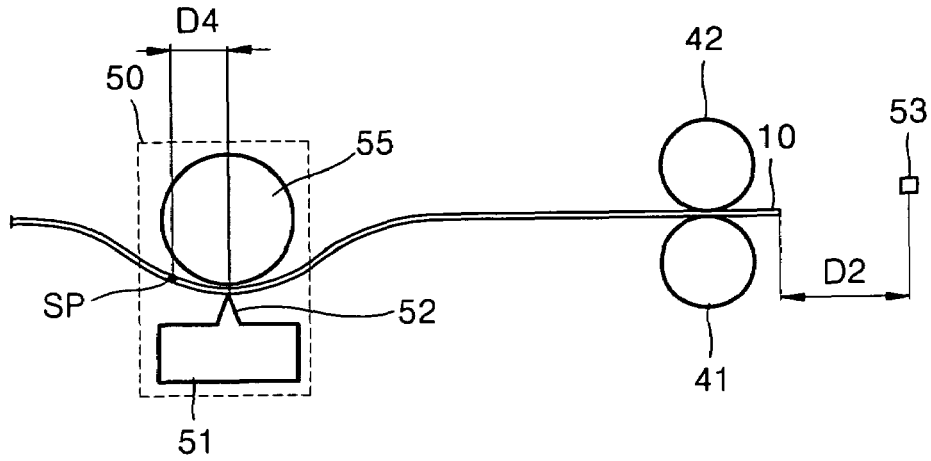

When the printing process for the first surface is completed, the medium 10 is further fed a predetermined distance forwardly so that the medium 10 does not contact the image forming unit 50 during a rotation of the image forming unit. In addition, the image forming unit 50 is rotated so that the TPH 51 faces the second surface of the medium 10 (operation 107 of FIG. 7). FIG. 8D shows the state where the TPH 51 is rotated.

Next, a gap, through which the medium 10 can pass without resistance, is formed between the platen roller 52 and the TPH 51 by descending the TPH 51 slightly. The medium 10 is backfed to the second path by the conveying unit 40 to prepare the printing process for the second surface (operation 108 of FIG. 7).

When the front edge FE of the medium 10 is detected by the optical sensor 53 (operation 109 of FIG. 7), the medium 10 is further backfed as much as a second distance D2 from the optical sensor 53 (operation 110). Here, the print starting position SP of the medium 10 is at a position that is further away, about the same amount as a fourth distance D4 from the TPH 51. The second distance D2 is a proceeding distance of the medium from the point, when the front edge FE of the medium 10 is detected, measured by the rotary encoder sensor 46.

Figure 8F:
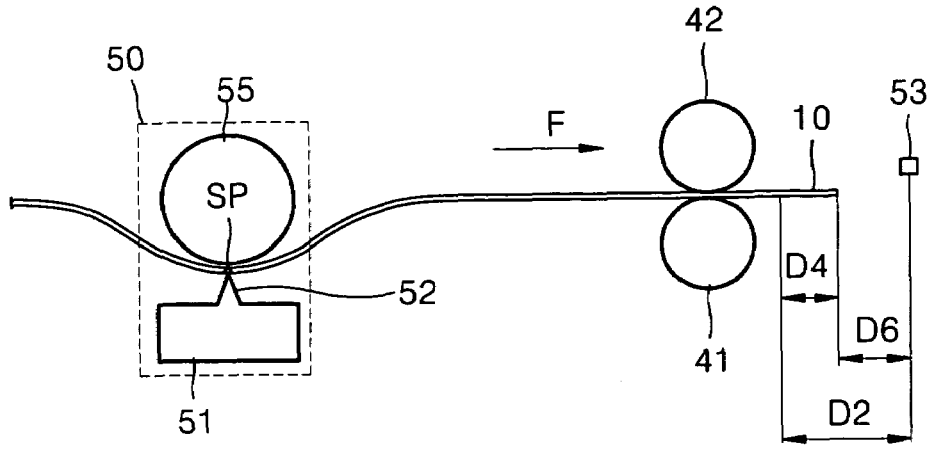

When the printing process for the second surface starts, the TPH 51 rises to adhere to the backfed medium 10. The feeding roller 41 feeds the medium 10, about the same amount as the fourth distance D4 to dispose the print starting position SP of the medium 10 under the heating element 52 of the TPH 51, as shown in FIG. 8F (operation 111 of FIG. 7).

Then, the controller 80 transmits color image data corresponding to the printing layer of the second surface, for example, cyan (C) image data, to the TPH 51 to perform the printing process (operation 112 of FIG. 7).

When the printing process for the second surface is completed, the medium 10 is conveyed to the third path. Then, the conveying unit 40 stops conveying the medium 10 and the medium 10 is discharged out of the printer by the media discharging unit 60 (operation 113 of FIG. 7).

In the above embodiment, printing is started for the first and second surfaces of the medium after back feeding the medium by first and second distances and forward feeding the medium by third and fourth distances, respectively. However, the embodiment of the present invention is not limited thereto. That is, the medium can be backfed about the same amount as a fifth distance D5 (refer to FIG. 8F), which is the distance calculated by subtracting the third distance D3 from the first distance D1, and a sixth distance D6 (refer to FIG. 8F), which is the distance calculated by subtracting the fourth distance D4 from the second distance D2. Thus, the print starting position can be disposed under the heating element of the TPH. The printing begins when printing for the corresponding surface is commanded.

According to the above printing method for aligning the image of the thermal media, the print starting position of the thermal media may be aligned and dual-surface printing may be performed.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of printing thermal media by aligning an image using a printer, the printer having a thermal printhead, a feeding roller, and an edge detection sensor sequentially disposed in a print proceeding direction, the method comprising the steps of:

detecting a front edge of the thermal medium using the edge detection sensor and feeding the thermal medium having a first surface and a second surface in a first direction so that the front edge of the thermal medium moves a first distance from the edge detection sensor, the thermal medium having a print starting position located at a position corresponding to a heating element of the thermal printhead;

performing a printing process for the first surface while feeding the medium in a second direction;

rotating the thermal printhead so that the thermal printhead faces the second surface of the thermal medium;

detecting the front edge of the thermal medium using the edge detection sensor and feeding the thermal medium in the first direction so that the front edge of the thermal medium moves a second distance from the edge detection sensor and the print starting position of the second surface is located at a position corresponding to the heating element of the thermal printhead; and performing a printing process for the second surface while feeding the thermal medium in the second direction.

2. The method of claim 1, wherein the edge detection sensor is an optical sensor.

3. The method of claim 1, wherein the feeding of the first surface of the thermal medium comprises:

controlling rotation of the feeding roller so that the front edge of the thermal medium moves about the same amount as the first distance from the sensor.

4. The method of claim 3, wherein the feeding of the second surface of the thermal medium comprises:

controlling rotation of the feeding roller so that the front edge of the thermal medium moves about the same amount as the second distance from the sensor.

5. A method of printing thermal media by aligning an image using a printer, the printer having a thermal printhead, a feeding roller, and an edge detection sensor sequentially disposed in a print proceeding direction, the method comprising the steps of:

feeding a thermal medium having a first surface and a second surface so that a front edge of the thermal medium moves a first distance from the edge detection sensor, the thermal medium having a print starting position located at a position corresponding to a heating element of the thermal printhead;

performing a printing process for the first surface while feeding the medium;

rotating the thermal printhead so that the thermal printhead faces the second surface of the thermal medium;

feeding the thermal medium so that the front edge of the thermal medium moves a second distance from the edge detection sensor and the print starting position of the second surface is located at a position corresponding to the heating element of the thermal printhead; and performing a printing process for the second surface while feeding the thermal medium, wherein the thermal medium includes a printing region and a tear-off region having the front edge, and the print starting position is formed on the tear-off region.

6. A method of printing thermal media by aligning an image using a printer, in which a thermal printhead, a feeding roller, and an edge detection sensor are sequentially disposed in a print proceeding direction, the method comprising the steps of:

detecting a front edge of a thermal medium using the edge detection sensor and feeding the thermal medium having first and second surfaces in a first direction so that a front edge of the thermal medium moves a first distance from the edge detection sensor, and a print starting position of the first surface is located at a position distant from a lower portion of a heating element of the thermal printhead;

starting a printing process for the first surface of the thermal medium when the print starting position is located at a position corresponding to the heating element, while feeding the thermal medium in a second direction;

rotating the thermal printhead so that the thermal printhead faces the second surface of the thermal medium;

detecting the front edge of the thermal medium using the edge detection sensor and feeding the thermal medium in the first direction so that the front edge of the thermal medium moves a second distance from the edge detection sensor and a print starting position of the second surface is located at a position distant from the heating element of the thermal printhead; and starting a printing process for the second surface when the print starting position is located at a position corresponding to the heating element, while feeding the thermal medium in the second direction.

7. The method of claim 6, wherein the edge detection sensor is an optical sensor.

8. The method of claim 6, wherein the feeding of the first surface of the thermal medium comprises:

detecting the front edge of the thermal medium using the edge detection sensor; and controlling rotation of the feeding roller so that the front edge of the thermal medium moves about the same amount as the first distance from the sensor.

9. The method of claim 8, wherein the feeding of the second surface of the thermal medium comprises:

detecting the front edge of the thermal medium using the edge detection sensor; and controlling rotation of the feeding roller so that the front edge of the thermal medium moves about the same amount as the second distance from the sensor.

10. The method of claim 6, wherein the first distance is a distance equal to the summation of a distance between the front edge and the print starting position, and a predetermined third distance, and the printing of the first surface is performed by starting the printing process when the thermal medium is fed as much as the third distance.

11. The method of claim 6, wherein the second distance is a distance equal to the summation of a distance between the front edge and the print starting position, and a predetermined fourth distance, and the printing of the second surface is performed by starting the printing process when the thermal medium is fed as much as the fourth distance.

12. A method of printing thermal media by aligning an image using a printer, in which a thermal printhead, a feeding roller, and an edge detection sensor are sequentially disposed in a print proceeding direction, the method comprising the steps of:

feeding a thermal medium having first and second surfaces so that a front edge of the thermal medium moves a first distance from the edge detection sensor, a print starting position of the first surface is located at a position distant from a lower portion of a heating element of the thermal printhead;

starting a printing process for the first surface of the thermal medium when the print starting position is located at a position corresponding to the heating element, while feeding the thermal medium;

rotating the thermal printhead so that the thermal printhead faces the second surface of the thermal medium;

feeding the thermal medium so that the front edge of the thermal medium moves a second distance from the edge detection sensor and a print starting position of the second surface is located at a position distant from the heating element of the thermal printhead; and starting a printing process for the second surface when the print starting position is located at a position corresponding to the heating element, while feeding the thermal medium, wherein the thermal medium includes a printing region and a tear-off region having the front edge, and the print starting position is formed on the tear-off region.

* * * * *